US008276596B2

(12) United States Patent
Marciniak-Davoult et al.

(10) Patent No.: US 8,276,596 B2
(45) Date of Patent: Oct. 2, 2012

(54) APPLICATOR FOR APPLYING A COMPOSITION TO THE EYELASHES

(75) Inventors: Pascale Marciniak-Davoult, Chatou (FR); Christian Salciarini, Dames (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 430 days.

(21) Appl. No.: 12/048,251

(22) Filed: Mar. 14, 2008

(65) Prior Publication Data

US 2008/0245382 A1 Oct. 9, 2008

Related U.S. Application Data

(60) Provisional application No. 60/896,097, filed on Mar. 21, 2007.

(30) Foreign Application Priority Data

Mar. 16, 2007 (FR) ..... 07 53879

(51) Int. Cl.
*A45D 24/00* (2006.01)
*A45D 40/26* (2006.01)

(52) U.S. Cl. ..... 132/200; 132/218; 132/320

(58) Field of Classification Search ..... 132/200, 132/202, 216, 217, 218, 313, 317, 318, 320, 132/120, 121, 126, 142, 148, 137, 141; 15/206, 15/207, 207.2; 401/122, 126–129, 121
See application file for complete search history.

(56) References Cited

U.S. PATENT DOCUMENTS

| | | | | |
|---|---|---|---|---|
| 4,403,624 | A * | 9/1983 | Montgomery | 132/218 |
| 4,404,977 | A * | 9/1983 | Vasas | 132/218 |
| 4,586,520 | A * | 5/1986 | Brittain | 132/218 |
| 4,662,385 | A * | 5/1987 | Schefer | 132/218 |
| 4,964,429 | A * | 10/1990 | Cole | 132/218 |
| 5,224,787 | A | 7/1993 | Vasas | |
| 5,335,465 | A | 8/1994 | Gueret | |
| 5,595,198 | A * | 1/1997 | Kemmerer | 132/218 |
| 5,657,778 | A * | 8/1997 | Gueret | 132/320 |
| 5,709,230 | A * | 1/1998 | Miraglia | 132/218 |
| 6,295,994 | B1 * | 10/2001 | Thayer et al. | 132/218 |
| 6,616,366 | B1 * | 9/2003 | Weihrauch | 401/286 |
| 7,089,946 | B2 * | 8/2006 | Rousselet | 132/218 |
| 7,121,284 | B2 * | 10/2006 | Gueret | 132/218 |
| 2003/0084913 | A1 * | 5/2003 | Gueret | 132/218 |
| 2004/0107974 | A1 * | 6/2004 | Paratore et al. | 132/218 |
| 2006/0162737 | A1 * | 7/2006 | Montoli | 132/218 |
| 2006/0272668 | A1 * | 12/2006 | Wyatt et al. | 132/218 |
| 2007/0204873 | A1 | 9/2007 | Kim | |
| 2009/0014022 | A1 * | 1/2009 | Salciarini | 132/200 |
| 2009/0065020 | A1 * | 3/2009 | Butcher et al. | 132/218 |
| 2009/0071500 | A1 * | 3/2009 | Wyatt et al. | 132/218 |
| 2009/0114239 | A1 * | 5/2009 | Chen | 132/218 |
| 2009/0193602 | A1 * | 8/2009 | Dumler et al. | 15/160 |
| 2009/0320872 | A1 * | 12/2009 | Vandromme | 132/218 |
| 2010/0037407 | A1 * | 2/2010 | Telwar | 15/160 |
| 2010/0071715 | A1 * | 3/2010 | Bickford | 132/218 |
| 2010/0089415 | A1 * | 4/2010 | Vandromme | 132/218 |

FOREIGN PATENT DOCUMENTS

| | | | |
|---|---|---|---|
| EP | 1475013 | A1 | 1/1991 |
| EP | 0410821 | A1 | 11/2004 |

* cited by examiner

*Primary Examiner* — Vanitha Elgart

(74) *Attorney, Agent, or Firm* — Jacox, Meckstroth & Jenkins

(57) ABSTRACT

An applicator for applying a composition to the eyelashes. The applicator has at least one brush sector that has a row of fibers and at least one comb having a row of teeth and having a shape that is generally helical.

34 Claims, 10 Drawing Sheets

APPLICATOR FOR APPLYING A COMPOSITION TO THE EYELASHES

BACKGROUND OF THE INVENTION

1. Field of the Invention

The invention relates to applicators for applying a composition, such as mascara, to the eyelashes, and/or the eyebrows.

2. Description of the Related Art

Such applicators have been known for many years. Applicators of various shapes and configurations have been proposed, but without always giving complete satisfaction to the user. The applicator is usually expected to fulfill a plurality of functions in the best possible manner. The first is an extending function. In other words, once makeup has been applied, the eyelashes should give the impression of being relatively long. The second function seeks to give volume: applying composition makes it possible to give the eyelashes a visible volume that is greater than their volume in their non-made up state. The third function is a curling function that seeks to curl the eyelashes as much as possible. A fourth function is the separation function: makeup should be applied to the eyelashes, keeping the eyelashes appropriately separated from one another, without clumping.

Applicators have been proposed that comprise a bottle brush. The advantage of the brush is that it can be loaded easily with a large quantity of composition, thereby avoiding any need for the user to put the applicator back frequently into the composition reservoir while applying makeup in order to load the applicator. Applicators have also been proposed comprising a comb. Such applicators make it possible to separate the eyelashes from one another properly.

Document EP-1 475 013 (U.S. Application Publication No. 2007204873) discloses an applicator comprising a plurality of brush sectors and a plurality of combs that are distributed around the longitudinal axis of the applicator. That applicator makes it possible to obtain good results in terms of applying makeup. However, it has been found that in order to obtain that result, the user must perform hand movements that require a certain amount of attention and a certain degree of skill.

OBJECTS AND SUMMARY OF THE INVENTION

An object of the invention is to provide an applicator that performs even better, in particular an applicator that makes it possible to obtain a good result in terms of length, curl, and volume while applying makeup with hand movements that are particularly simple and easy to implement.

To this end, the invention provides an applicator for applying a composition to the eyelashes and/or the eyebrows, the applicator comprising:

at least one brush sector comprising a row of fibers; and at least one comb comprising a row of teeth and having a shape that is generally helical.

Surprisingly, it has been found that the helical configuration of such a brush makes it possible to obtain a makeup result that is very satisfactory with a hand movement that is particularly simple and easy for the user to execute. This hand movement makes it possible to apply a substantial quantity of composition to the eyelashes. The applicator catches all of the eyelashes coming into contact therewith. In particular, the eyelashes are engaged in the teeth of the comb and they are subjected to uniform treatment. In particular, it should be observed that the applicator implements the four eyelash treatment functions (volume, separation, lengthening, and curling) simultaneously on each of the eyelashes, and does this over the entire length of the eyelash from its base to its free end.

The brush sector or each brush sector of the applicator of the invention makes it possible to catch the eyelashes and to apply the composition gently to each of them. The composition is appropriately distributed over the eyelashes, and quickly imparts a certain volume and shine to each eyelash while curling it.

The comb or each comb makes it possible to treat the eyelashes individually, separating them from one another and producing a lengthening effect. The comb entrains the composition along the entire length of each eyelash, and also encourages good distribution. Makeup is applied to the eyelash from the root to the tip, and said eyelash is suitably curled.

More generally, the invention makes it possible to obtain a better result, in terms of makeup effect, than is obtained with an applicator of the bottle-brush type. It gives volume to the eyelashes, but without clumping them. And the eyelashes are not stuck together. Compared with an applicator that is constituted by a comb only, the invention also makes it possible to avoid forming clumps.

The applicator of the invention also makes it possible to increase the reproducibility of the result constituted by the makeup effect. Since application is performed by means of a simple and quick hand movement, the result is obtained immediately. The user therefore reloads the applicator less often than with a conventional applicator. The movement of air in the composition reservoir is decreased. The properties, in particular the rheological properties, of the composition contained in the reservoir are therefore preserved over a longer period of time. The makeup result achieved thereby is itself therefore also reproducible over a longer period of time.

Moreover, it has been found that such an applicator can make it possible to obtain different makeup effects depending on the kind of hand movement employed to apply the makeup.

Thus, if the user passes the applicator over the eyelashes using a hand movement that is straight, without turning the applicator, then, by means of this simple hand movement, the user immediately obtains the volume, separation, lengthening, and curling effects. In this way, it is possible, in particular, to impart the conventional fan configuration to the eyelashes.

It is also possible to manipulate the applicator using a turning hand movement (with turning being performed about an axis that usually corresponds to the longitudinal direction of the applicator). As a result of the presence of the helix, it should be observed that this hand movement makes it possible to orientate the eyelashes towards the outside of the eye, i.e. away from the other eye. A set of eyelashes is thus placed in a configuration that was previously unknown. It is possible for the resulting effect to be referred to as doe-eyed or side-long.

The applicator thus has, in particular, the advantage of making it possible to obtain two makeup results of different configurations depending on the type of hand movement performed, both of which are very simple for the user.

Furthermore, if the dimensions of the applicator and/or the number of brush sectors and the number of combs are selected appropriately, the eyelashes are simultaneously in contact with at least one brush sector and at least one comb, thus obtaining a result that is particularly clear in terms of volume and separation of the eyelashes.

The fibers of the brush sector or of each brush sector could be bristles or filaments. The row of fibers could be a row of individual fibers or a row of tufts of fibers. The brush sector or at least one of the brush sectors could comprise at least two rows of fibers.

The applicator of the invention could further present at least one of the following characteristics:

- the brush sector, or at least one of the brush sectors, presents a shape that is helical;
- the number of rows having a helical shape is greater than or equal to two, with the rows having helixes that have the same axis and/or that are oriented in the same direction;
- each row has a helical shape;
- the helix, or at least one of the helixes, extends over an angular sector, about an axis of the applicator, that lies in the range 10° to 360°, in particular in the range 20° to 130°, and preferably in the range 50° to 100°;
- the number of brush sectors is greater than or equal to two, in particular greater than or equal to three, and preferably equal to three;
- the brush sectors are evenly spaced apart;
- the number of combs is greater than or equal to two, in particular greater than or equal to three, and preferably equal to three;
- the combs are evenly spaced apart;
- the number of brush sectors is equal to the number of combs; and
- the rows are uniformly distributed about an axis of the applicator.

Advantageously, the teeth of the comb or of each comb are disposed locally one behind another in a zigzag configuration or in an undulating configuration.

The combing effect obtained by the comb or each comb is thus increased. The phenomenon of creating a store of composition at the bases of the teeth and between said teeth is also increased, thereby making it possible to load the applicator with a large quantity of composition on being removed from the reservoir.

The comb or at least one of the combs advantageously comprises at least two rows of teeth, the teeth of each row being aligned locally with one another, and being offset or inclined relative to the teeth of the other row or of one of the other rows.

The storage effect can also be observed in this embodiment, this time between the two rows of the comb.

The teeth of one of the rows advantageously diverge from their bases relative to the teeth of the other row or of one of the other rows.

Storage is likewise generated, but closer to the tips of the teeth.

The comb or one of the combs advantageously extends radially, relative to an axis of the applicator, beyond a surface envelope defined by the brush sector(s).

This arrangement increases the combing effect.

The brush sector, or at least one of the brush sectors, advantageously presents a color that is different from the color of the comb or of at least one of the combs.

This difference in color makes it possible to control better the composition-loading state of the applicator during use. When the applicator is removed from the reservoir, it is loaded with composition and all of it presents the color of said composition, usually black for mascara. During use, the composition disappears progressively, and the difference in color between brush and comb sectors appears little by little. At a certain stage, the user can thus decide to reload the applicator by replacing it in the reservoir.

The applicator advantageously includes at least one separator that extends in a plane that is perpendicular to a longitudinal axis of the applicator, being contiguous with one of the rows.

It is thus possible to define and to distinguish different groups of eyelashes.

It could be envisaged that the number of separators is greater than or equal to two, the separators being offset from one another longitudinally along the axis and/or angularly about the axis.

The brush sector or each brush sector is advantageously a single part. If the brush sectors are at least two in number, they could form a single part.

Provision could be made for the applicator to be a single part.

The invention also provides a kit for applying a composition to the eyelashes and/or the eyebrows, the kit comprising a composition reservoir and an applicator of the invention, the kit preferably further comprising a wiper.

The invention also provides a method of applying makeup to the eyelashes and/or the eyebrows, in which method a composition is applied to the eyelashes and/or the eyebrows by means of an applicator of the invention.

The applicator is advantageously moved in translation along the eyelashes or the eyebrows along a direction that is parallel thereto.

Also advantageously, the applicator is moved along the eyelashes or the eyebrows with movement that comprises turning movement, the movement possibly further comprising movement in translation.

Still advantageously, the applicator is moved along the eyelashes or the eyebrows in a direction away from the nose of the person whose eyelashes or eyebrows are having makeup applied thereto.

Finally, the invention provides a makeup effect that is obtained using an applicator of the invention, or by means of a method of the invention.

BRIEF DESCRIPTION OF THE DRAWINGS

The invention can be better understood on reading the following description of several embodiments, given by way of non-limiting example, and with reference to the accompanying drawings, in which.

Figure 2:
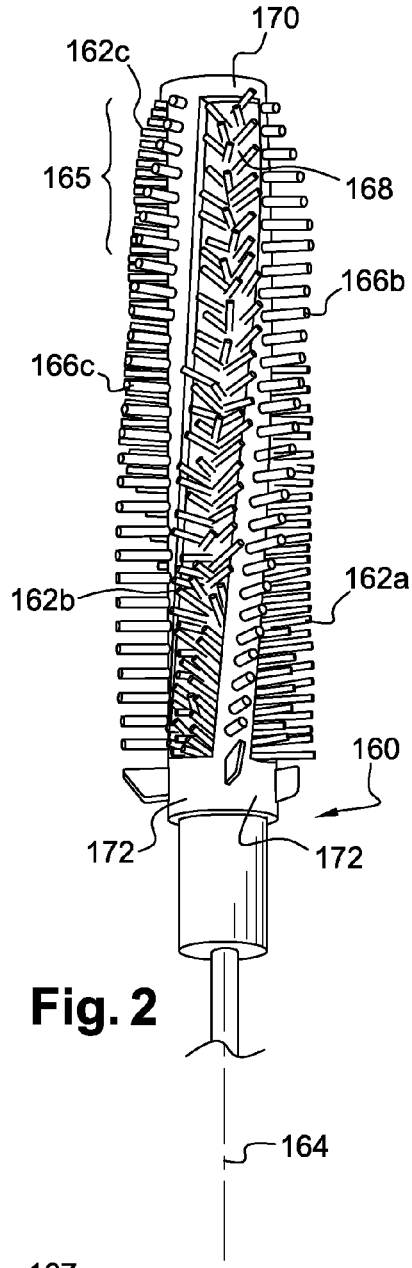
FIGS. 2 & 3 are larger scale views respectively from the side and from the end of the applicator endpiece of the FIG. 1 kit.
Figure 3:
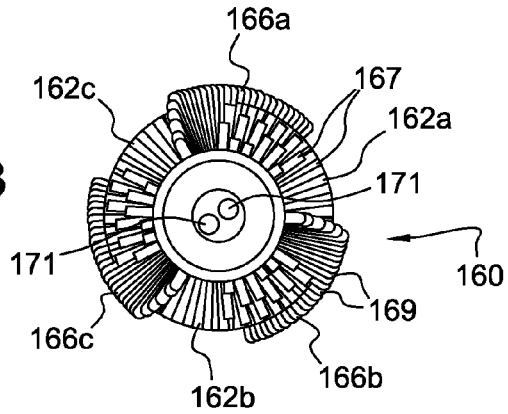
Figure 10:
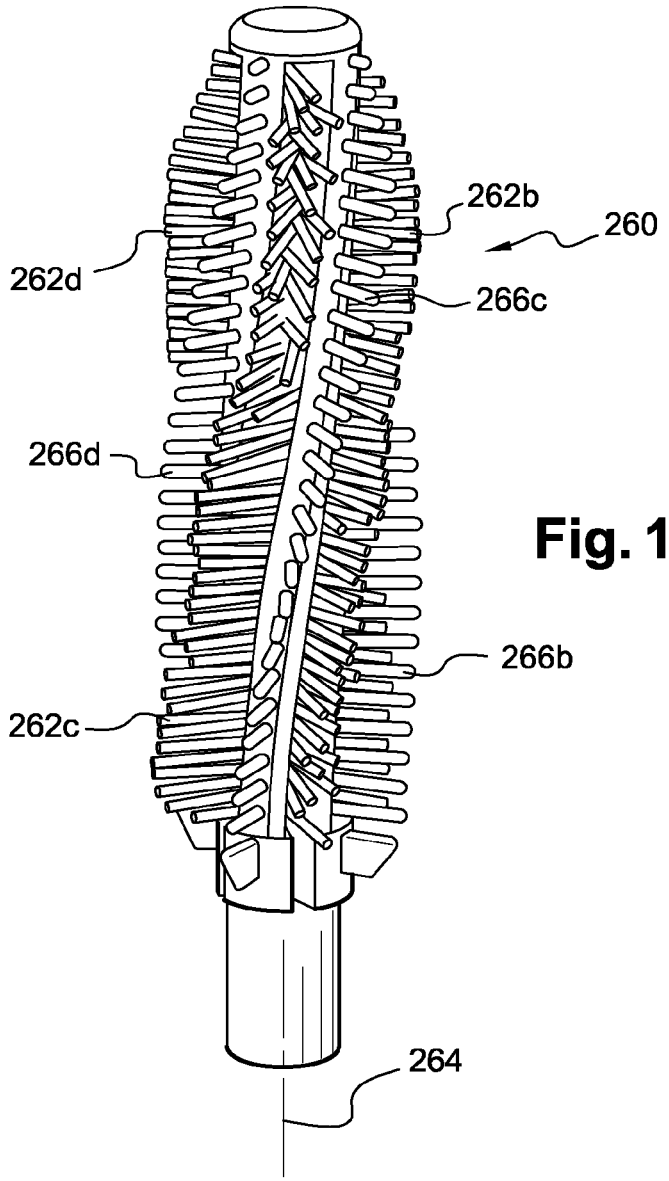
Figure 11:
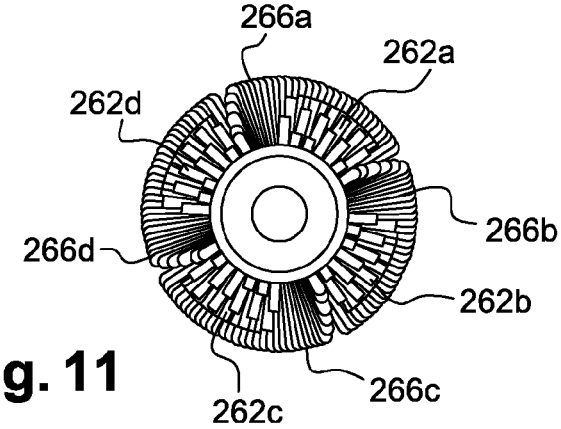
Figure 12:
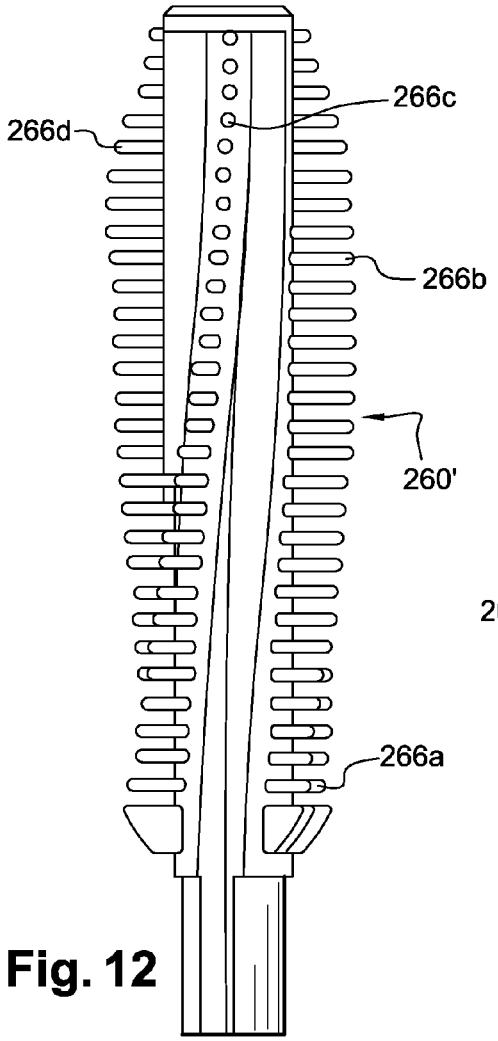
Figure 14:
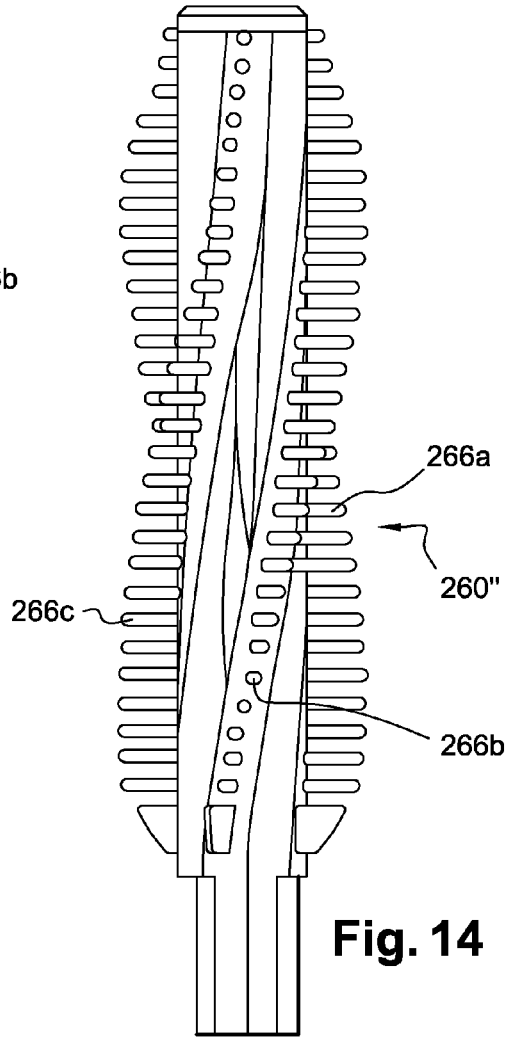
Figure 13:
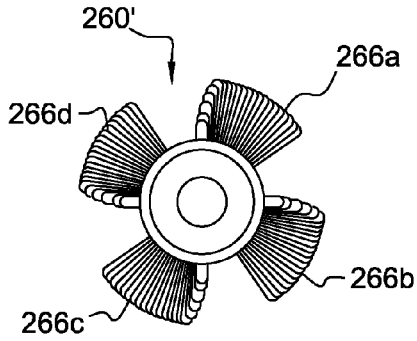
Figure 15:
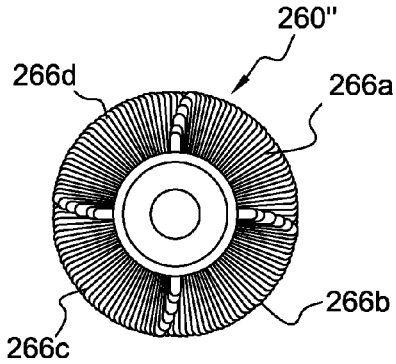
Figure 22:
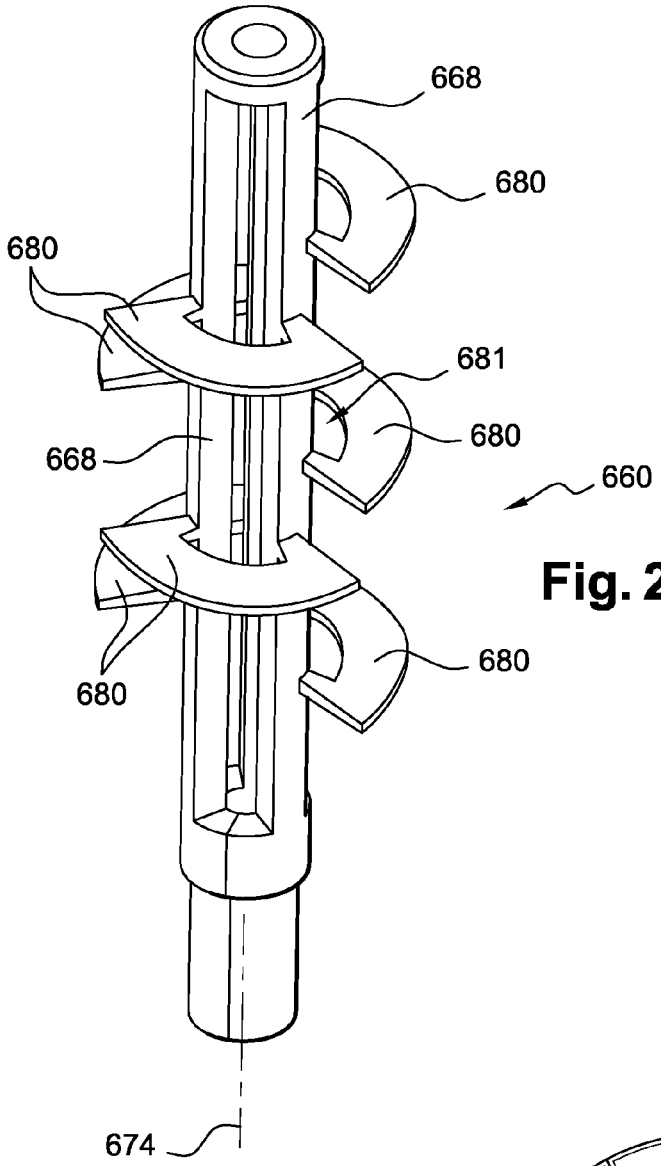
Figure 23:
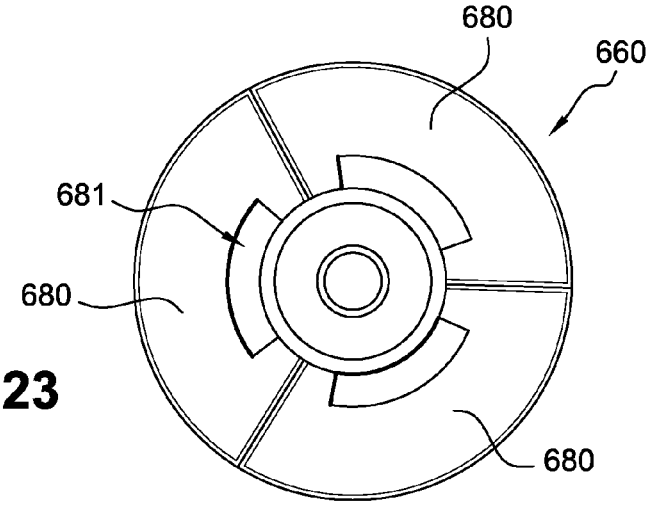
Figure 24:
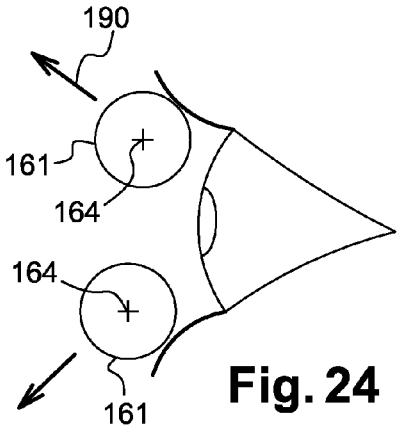
Figure 25:
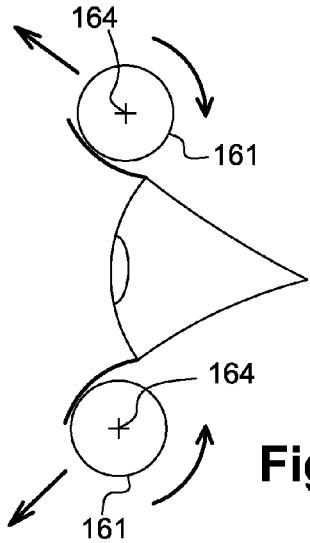
Figure 26:
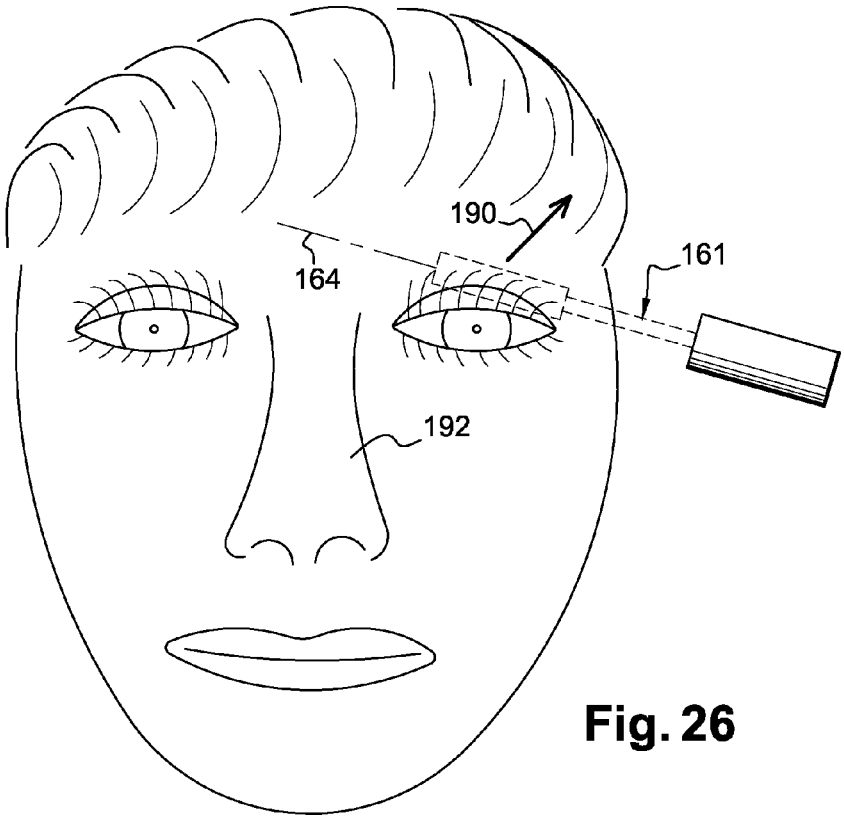

The pairs of FIGS. 4 & 5, 6 & 7, and 8 & 9 are views similar to FIGS. 2 & 3 showing variant embodiments;

FIGS. 10 & 11 are views similar to FIGS. 2 & 3 showing a second embodiment of the invention;

The pairs of FIGS. 12 & 13, and 14 & 15 are views similar to FIGS. 10 & 11 showing two variant embodiments;

The pairs of FIGS. 16 & 17, 18 & 19, and 20 & 21 are views similar to FIGS. 2 & 3 showing third, fourth, and fifth embodiments respectively;

FIGS. 22 & 23 are views similar to FIGS. 2 & 3 showing a sixth embodiment, with only some portions of the endpiece showing;

FIGS. 24 & 25 are profile views of an eye with eyelashes that are having makeup applied thereto by means of an applicator of the invention; and FIG. 26 is a front view of a face with eyelashes that are having makeup applied thereto by means of an applicator of the invention.

DETAILED DESCRIPTION OF THE DRAWINGS

Figure 1:
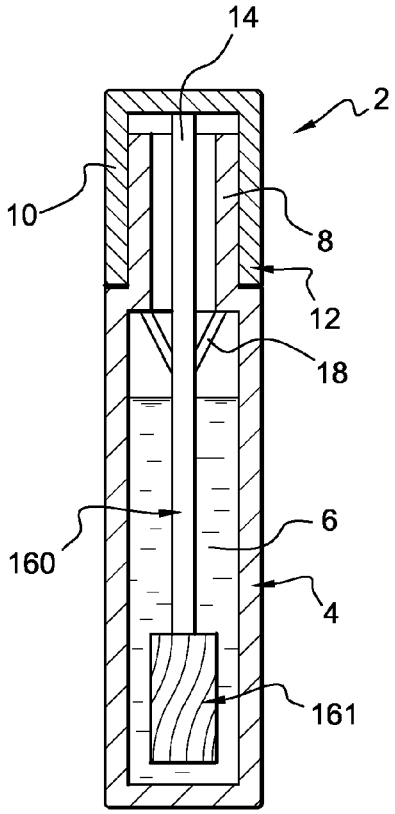
FIG. 1 is an axial section view of a makeup kit constituting a first embodiment of the invention.

FIG. 1 shows a makeup kit 2 of the invention for applying makeup to the eyelashes. The kit includes a reservoir 4 containing the composition 6 (in this embodiment a mascara) for application to the eyelashes. The reservoir 4 is extended at its top portion by a neck 8. The kit includes an applicator 160 that includes a handle portion 12 with a skirt 10. On its outside face, the neck 8 presents a thread (not shown) that co-operates with an internal thread of the skirt 10. The applicator 160 includes a stem 14 that is connected via its proximal end to the handle portion 12, and via its distal end to an endpiece 161 for coming into contact either with the mascara situated in the reservoir as shown in FIG. 1, or with the eyelashes. In this embodiment, the stem is rectilinear and elongate, having a circular section. The kit includes a wiper 18 having a top edge that is fastened to the neck 8, and a bottom edge that is in contact with the stem 14 when it is received in the reservoir, so as to wipe said stem and the endpiece 161 in order to eliminate surplus composition therefrom while the applicator 160 is being removed from the reservoir 4.

With reference to FIGS. 2 & 3, the endpiece of the first embodiment includes three brush sectors 162*a*, 162*b*, and 162*c*, each extending from one longitudinal end of the endpiece to the other. The three sectors are distributed uniformly about the longitudinal axis 164 of the endpiece that is the longitudinal axis of the stem 14.

The endpiece also includes three combs 166*a*, 166*b*, and 166*c* that are also evenly distributed about the axis 164, with each comb extending from one end of the endpiece to the other. The combs alternate with the brush sectors, about the axis 164. Each brush sector is equidistant from the two adjacent combs and vice versa. As a result, the brush sectors 162*a*, 162*b*, and 162*c* are separated from one another by one third of a turn about the axis 164, i.e. by 120°. The same applies for the mutual spacing between the combs. As a result, each brush sector presents an angular spacing of 60° with each adjacent comb. The brush sectors are positioned in stationary manner relative to the combs. The brush sectors and the combs are arranged such that they are suitable for extending on one side of the eyelashes so as to come into contact therewith, as shown in FIGS. 24 and 25, for example.

Each brush sector 162*a*, 162*b*, 162*c* is formed by a row of tufts of fibers or of bristles 167, whereas each comb 166*a*, 166*b*, 166*c* is formed by a row of teeth 169. In the present embodiment, the fibers of each brush sector are oriented radially relative to the axis 164. The same applies for the teeth of each comb.

Specifically, each of the brush sectors and each of the combs present a helical shape about the axis 164. In this embodiment, the inclination of the helix is constant from one longitudinal end of the endpiece to the other. (The same therefore applies for its pitch.) It is possible to envisage that the endpiece has a length that lies in the range 20 millimeters (mm) to 30 mm, for example, or more generally in the range 15 mm to 35 mm. In this embodiment, the length of the endpiece is about 25 mm. Given this length for the endpiece, it is possible to measure the inclination of each helix by the angular spacing about the axis 164 between the first and the last elements of each comb or of each brush sector. As can be observed, in particular in FIG. 3, each comb thus extends over about 76° about the axis 164 in the present embodiment. The same applies for each brush sector. In this embodiment, the pitch of each helix is therefore 118 mm.

More generally, and by way of example, it is possible to envisage any one of the following angular spacing values in this embodiment and in the following embodiments, together with their corresponding pitch values:

| | Angular sector in degrees | | | | | | | | | | |
|---|---|---|---|---|---|---|---|---|---|---|---|
| | 26.5 | 30 | 52.8 | 54 | 55 | 60 | 76 | 80 | 90 | 105.8 | 120 |
| Pitch in mm | 340 | 300 | 170 | 167 | 164 | 150 | 118 | 113 | 100 | 85 | 75 |

In this embodiment, the helixes of the six rows respectively forming the combs and the brush sectors are all oriented in the same direction, giving the general impression of an endpiece that is twisted. When the endpiece is observed with its axis vertical and with its free end directed upwards, the direction of the helixes is such that the brush sectors and the combs situated on the side of the observer rise along the axis from the bottom lefthand side to the top righthand side.

In each brush sector, the fibers are all the same length over the greatest portion of the endpiece, except in the distal portion 165 furthest from the handle portion 12 that corresponds to about 20% of the length of the sector. In this portion, the lengths of the fibers decrease progressively. The same applies for the distribution of the lengths of the teeth of each comb, such that the lengths of the teeth also decrease at the distal portion 165 of the endpiece. The short lengths close to the free end of the applicator enable the small eyelashes situated at the two corners of each eye to be treated better.

As can be seen in particular in FIG. 3, in the radial direction, the length of the teeth 169 is longer than the length of the fibers 167 forming the brush sectors. In the present embodiment, the teeth are about 5 mm long over the major portion of the endpiece, whereas the fibers of the brush sectors present a length of 4 mm over the same portion. Over the entire endpiece, the combs extend radially beyond the envelope surface of the brush sectors, said surface being cylindrical over the major part of the length of the endpiece, and cone shaped over the portion 165. The portion of the combs that protrude out of the brush sectors make it possible to increase the separation and lengthening effect obtained by the combs, and to increase the uniformity with which the composition is applied to the eyelashes.

In order to make the brush sectors, it is possible to provide a bottle brush comprising a stem formed by two twisted metal wires 171 that trap fibers or bundles of fibers between them, as is known per se. Three sectors could be obtained on the brush either by cutting segments of brush, forming free spaces therebetween, or by locally flattening the brush. The metal stem of the brush is fastened to the end of the stem 14, e.g. being force fitted into said stem.

Each comb includes a base 168 or bar having a cross-section that is rectangular in shape, for example, or indeed square. The teeth project from a single side of the base opposite the side facing the twisted stem of the brush. By way of example, the combs are formed by being connected together at their distal longitudinal ends via a connection piece 170 that is common to the three combs, their proximal longitudinal ends 172 being originally free from one another. The three combs thus form the three portions of a cage. The combs can be installed on the brush by bringing the connection piece 170 to the distal end of the brush and by folding the three combs around the brush sectors, between said sectors, so as bring their ends 172 into contact.

In this embodiment, the fibers of the brush sectors are made of plastics material, e.g. of polyamide as sold under the tradename Nylon.

The combs can also be made of plastics material. In this embodiment, the plastics material is a polybutyl terephthalate (PBT) elastomer sold by the supplier Dupont de Nemours under the trade name Hytrel®.

The fibers could have a diameter of 3 thousandths of an inch (mils) to 4 mils, or even 5 mils, for example. The fibers could be solid or hollow fibers, or could even form a mixture of solid and hollow fibers. Some of the teeth of the combs could have a polished surface state, and others could have an unpolished state so as to catch the eyelashes better.

The endpiece having three brush sectors and three combs that are equidistant from one another about the axis 164 and that each have a helical shape, give a particularly good result in terms of makeup effect. The endpiece makes it possible to deposit enough composition on each eyelash without overload and without the composition being eliminated by the combs.

In this embodiment, the combs are originally of a color, e.g. white, that is different from the color of the brush sectors, e.g. black. This difference in color enables the user to control better loading the applicator with composition. When the endpiece is removed from the wiper and from the neck, it is loaded with composition and all of it presents the color of said composition, usually black for mascara. During use, the composition progressively disappears from the endpiece and the combs return little by little to their white color. At a certain stage, the user can thus detect that the endpiece is no longer sufficiently loaded with composition, and can decide to reload the applicator by replacing it in the reservoir. Conversely, it is possible to provide black combs and white brush sectors. In a variant, colors other than black and white can be used for the various portions of the endpiece.

In the following figures, and with the exception of FIGS. 10, 11, 22, and 23, only the combs of the endpieces are shown for clarity in the drawing. Naturally, a plurality of brush sectors are present each time.

Figure 4:
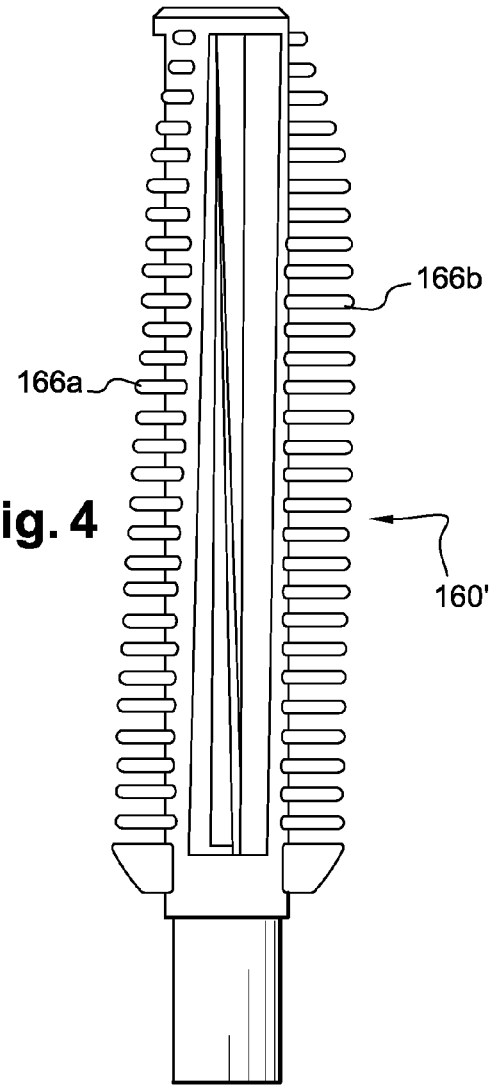
Figure 6:
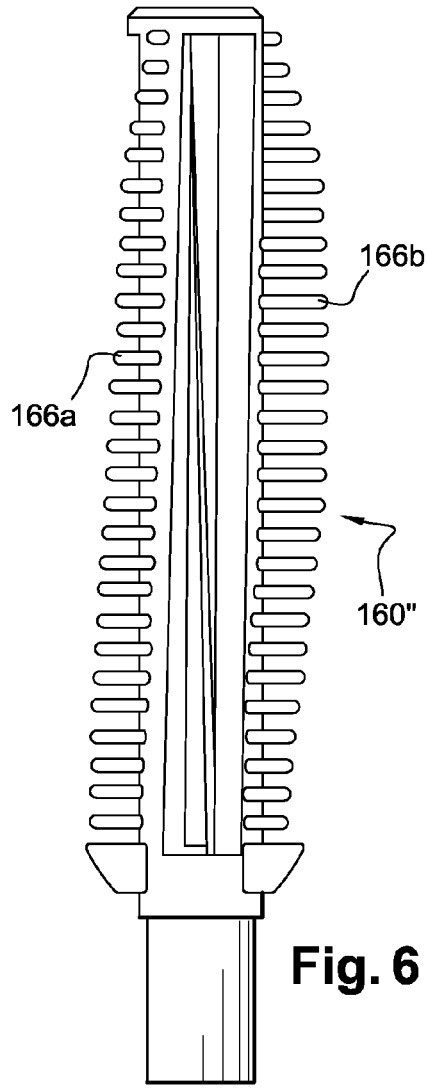
Figure 5:
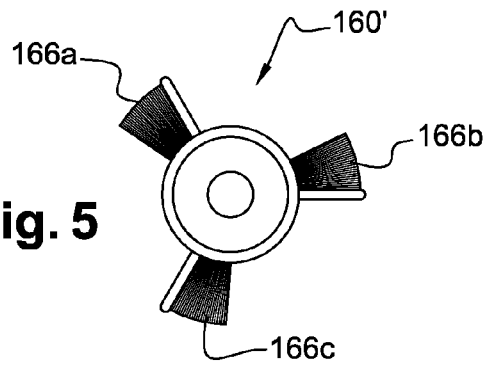
Figure 7:
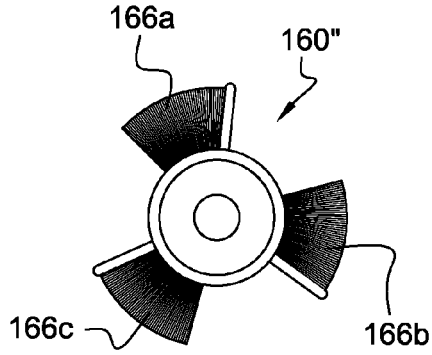

A variant of this first embodiment is shown in FIGS. 4 & 5. The characteristics of the applicator 160' are the same as the characteristics of the applicator 160 except that the inclination of each helix is more pronounced (relative to a plane that is perpendicular to the axis) such that the angular offset between the first tooth and the last tooth of each comb 166*a*, 166*b*, 166*c* is decreased to 26.5°. Naturally, the same applies for the brush sectors.

In the variant in FIGS. 6 & 7, once again it is only the angular offset that varies. In the applicator 160", the offset is this time close to twice the offset of the previous two figures, and is taken to 52.8°.

Figure 8:
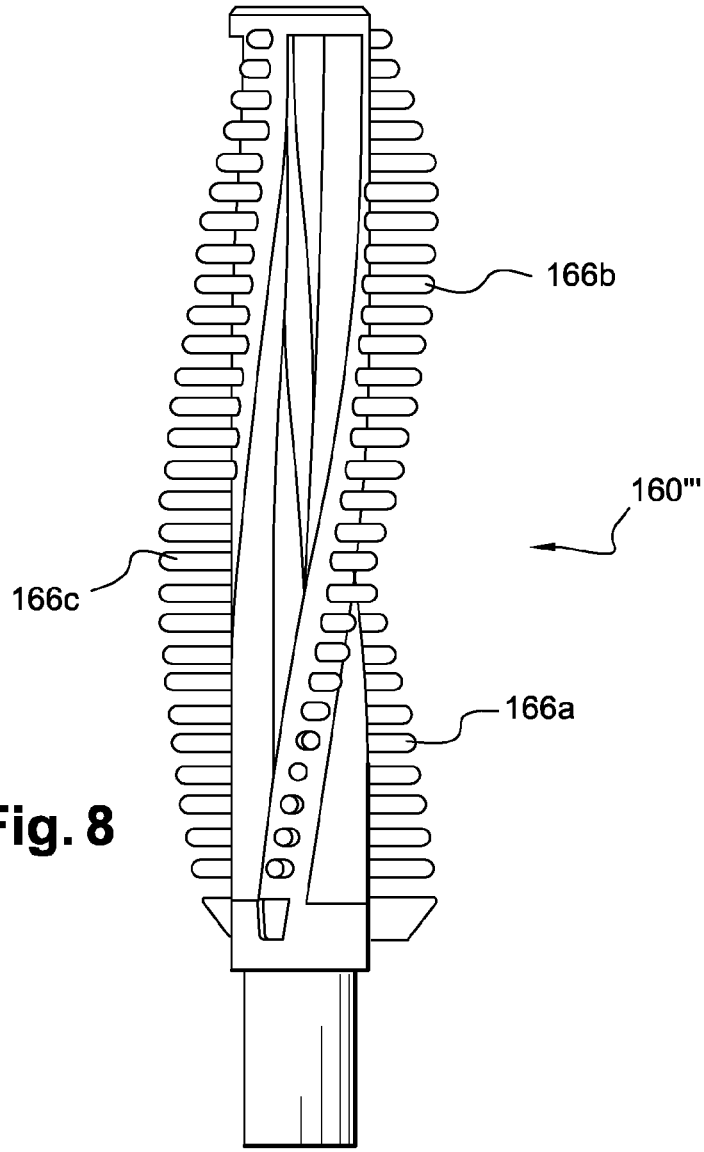
Figure 9:
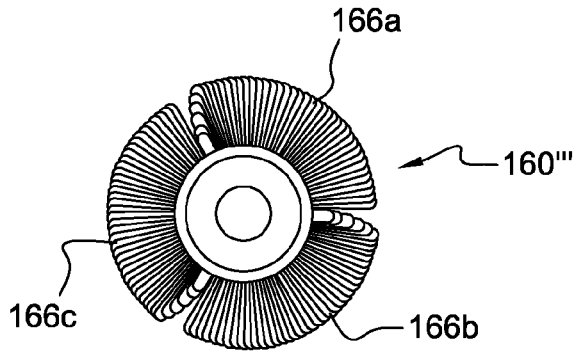

In the applicator 160'" of the variant in FIGS. 8 & 9, the angular offset is increased and this time rises to 120°.

Other embodiments of the applicator endpiece are presented below.

A second embodiment of the endpiece of the applicator of the invention is shown in FIGS. 10 & 11. The endpiece of this applicator 260 has a general configuration that is very close to the configuration in FIGS. 2 & 3. It thus includes a plurality of brush sectors and a plurality of combs. However, in this embodiment, the number of brush sectors 262*a*, 262*b*, 262*c*, and 262*d* is four, as is the number of combs 266*a*, 266*b*, 266*c*, and 266*d*. Once again, the brushes alternate with the combs, about the axis 264.

The pitch of the helix in this embodiment is such that the angular offset between the first tooth and the last tooth of each comb is 90°. Naturally, it is possible to modify this angular offset while keeping the number of brush sectors equal to four, and the number of combs equal to four.

This is shown in the following two variants. Thus, with reference to FIGS. 12 & 13, a variant of the endpiece of the applicator in FIGS. 10 & 11 is shown that differs therefrom only by the fact that the angular offset in each helix is decreased to 54°. It is about 100° on the endpiece shown as a variant in FIGS. 14 & 15.

Figure 16:
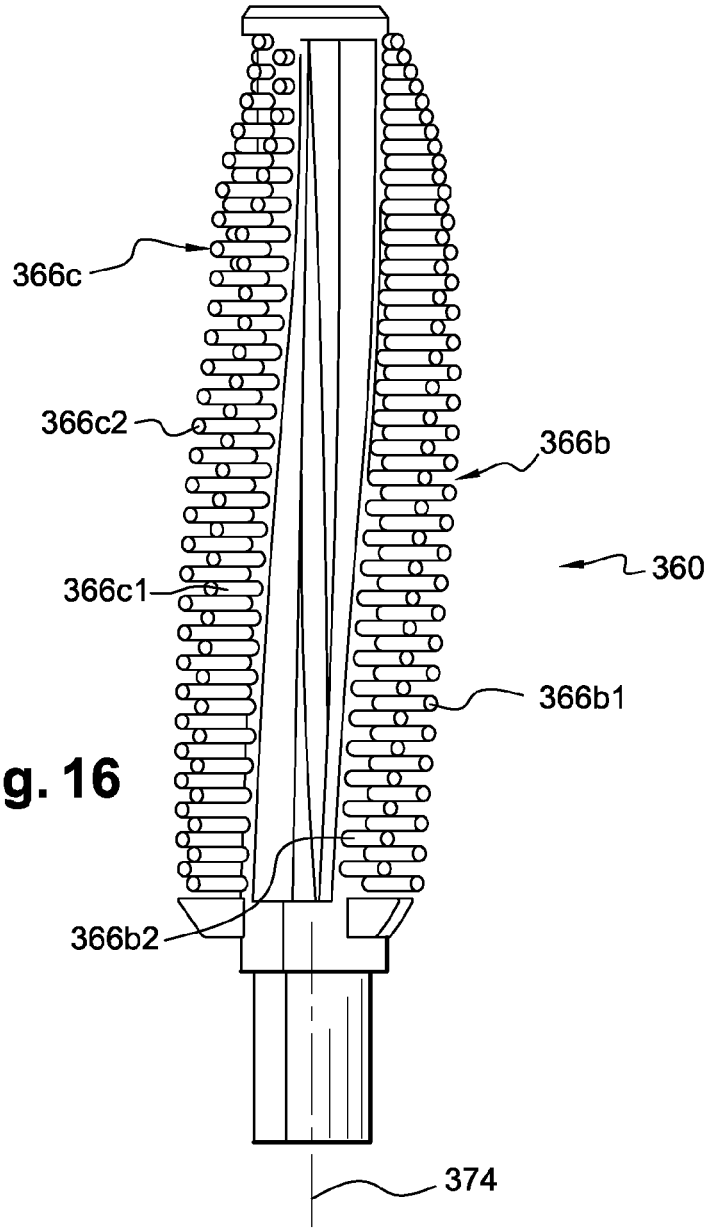
Figure 17:
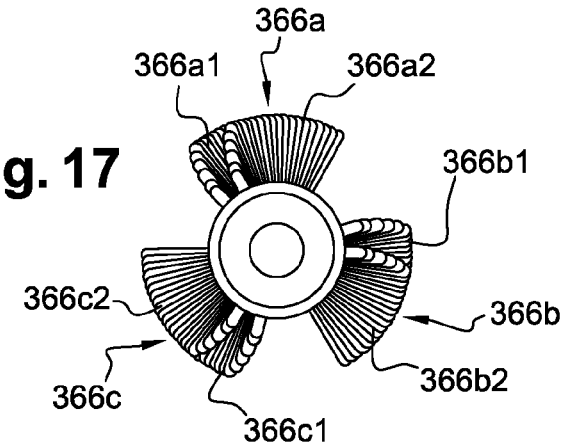

A third embodiment of the applicator of the invention is shown in FIGS. 16 & 17. The endpiece of this applicator differs from the applicator in FIGS. 2 & 3 only by the fact that each of the three combs 366*a*, 366*b*, and 366*c* is constituted not by a single row of teeth but by two rows of teeth 366*a*1 & 366*a*2, 366*b*1 & 366*b*2, and 366*c*1 & 366*c*2. In each row, the teeth are disposed precisely one behind another so as to form a helix. The distance between the two rows is constant along the comb. Also in each row, the teeth have a radial orientation relative to the axis 374 of the stem, such that the teeth of a row are closer at their bases to the teeth of the other row than they are at their tips. It should be observed that the angular distance between the two rows of each comb is much less than the angular distance between one comb and another comb. By way of example, the distances are 20° and about 100° respectively. The presence of two rows of teeth in each comb makes it possible to form stores of composition between the two rows in order to increase the load of composition taken by the endpiece while it is being removed from the reservoir. In this embodiment, each helix extends over a 60° sector.

Figure 18:
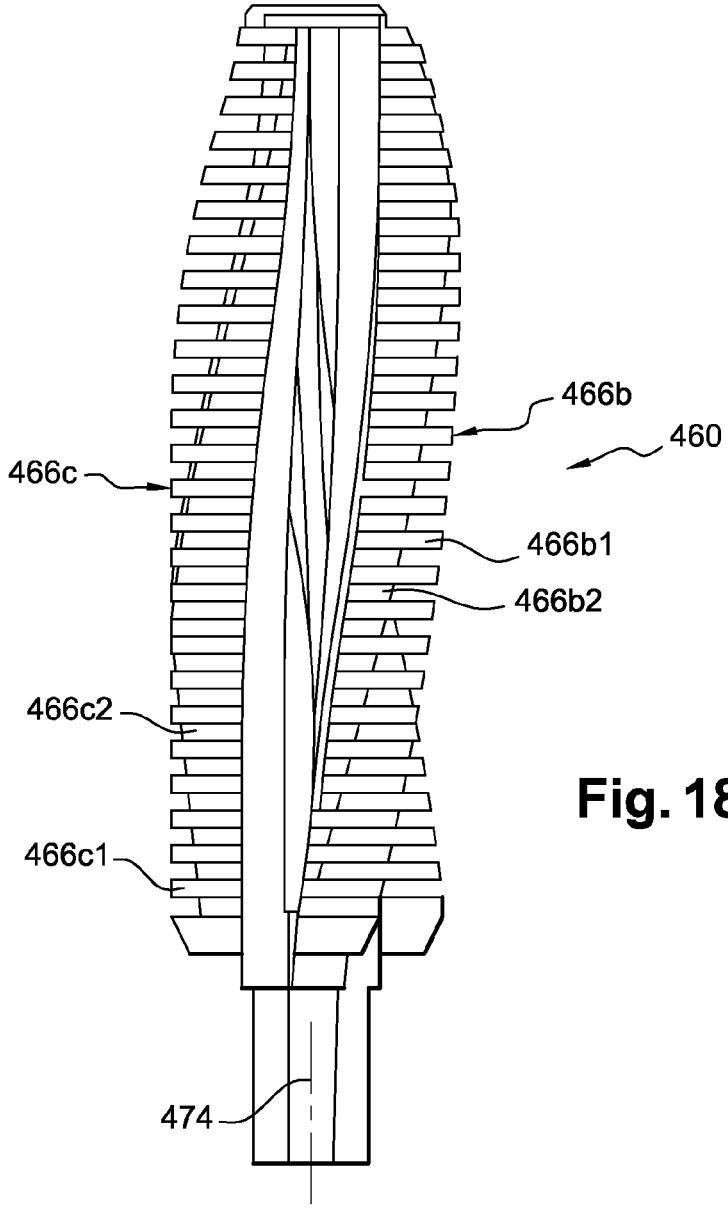
Figure 19:
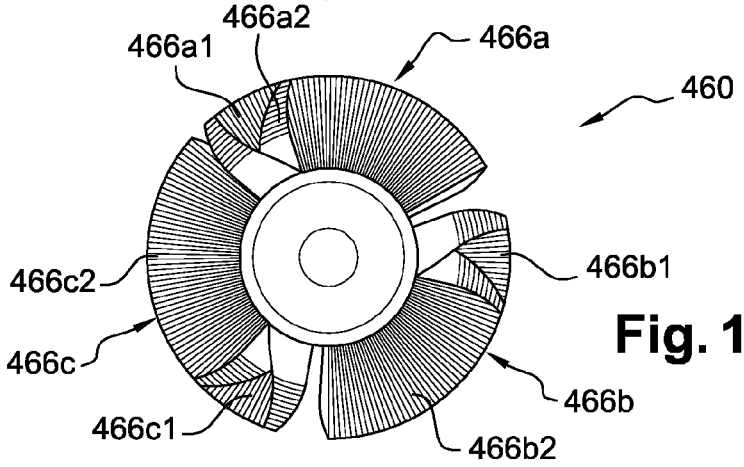

A fourth embodiment is shown in FIGS. 18 & 19. As in the previous embodiment, each of the three combs 466*a*, 466*b*, and 466*c* of the applicator 460 presents two rows of teeth 466*a*1 & 466*a*2, 466*b*1 & 466*b*2, and 466*c*1 & 466*c*2. However, contrary to the previous embodiment, the teeth of the two rows are such that their bases are aligned so as to form a single row. The teeth of one of the rows diverge away from the teeth of the other row starting from said base. The teeth of each row are therefore inclined relative to the direction that is radial to the axis 474, and in the opposite direction to the teeth of the other row. In the present embodiment, each tooth has a triangular shape when viewed from the end of the endpiece, as shown in FIG. 19. The base of the tooth constitutes the smallest side of the triangle. Once again, making each comb with a double row of teeth makes it possible to constitute a composition store between the two rows of each comb. Knowing that relatively little space is left free for the composition in the vicinity of the bases of the teeth, the major portion of the store is this time formed at a distance from the base, in the vicinity of the free end of each tooth. In this embodiment, each helix extends over an 80° sector.

Figure 20:
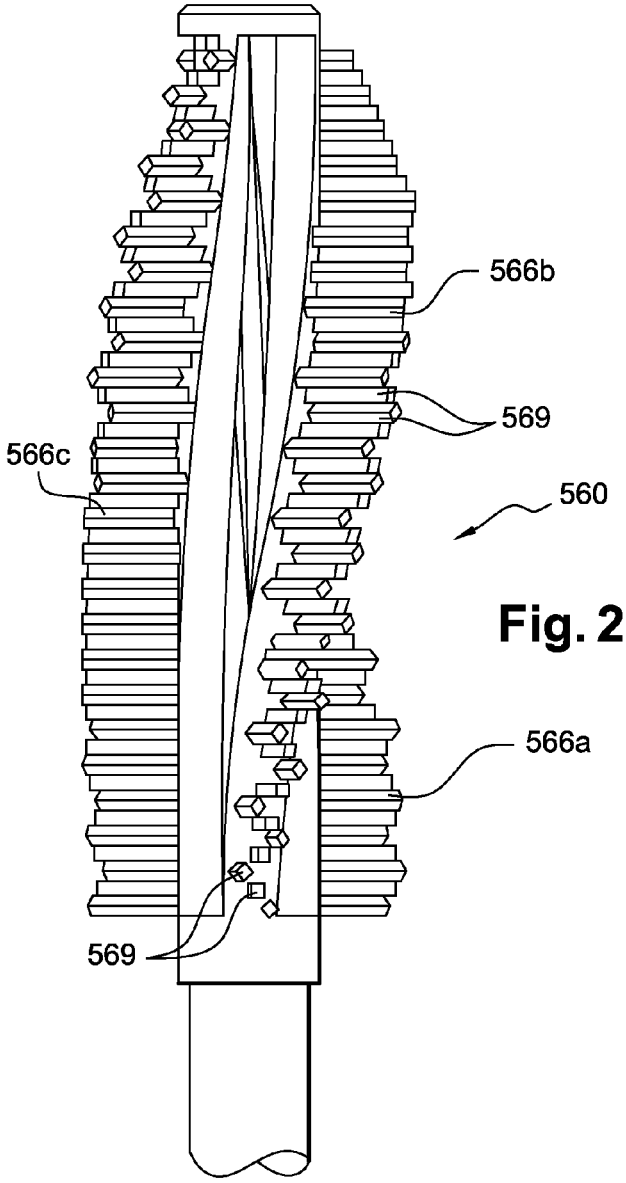
Figure 21:
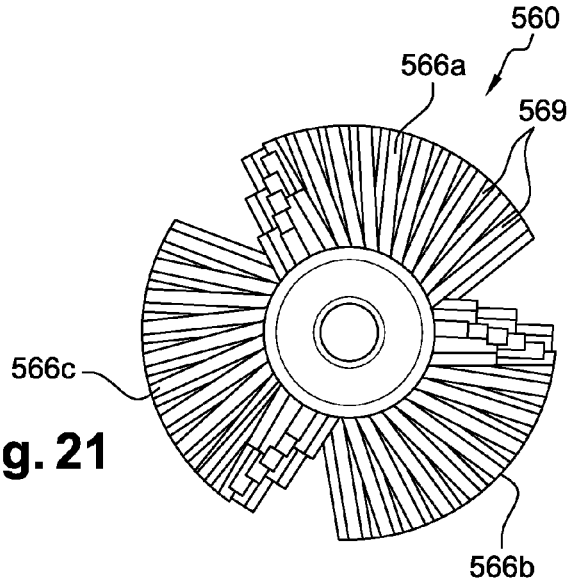

A fifth embodiment of the applicator 560 is shown in FIGS. 20 & 21. This embodiment differs from the embodiment in FIGS. 2 & 3 by the fact that although the rows of teeth 569 forming each of the three combs 566*a*, 566*b*, and 566*c* conserve a shape that is generally helical, they do not present a shape that is helical locally. It should be observed that the teeth 569 are disposed locally one behind another so as to form a zigzag configuration or even an undulating configuration. This arrangement is such that it is in fact also possible to distinguish three rows of teeth within the comb that are respectively constituted by the teeth forming a first series of ridges situated on one side of the undulation, the teeth forming a second series of ridges situated on the opposite side of the undulation, and the teeth that are situated mid-way between the two ridges. This embodiment increases the eyelash combing effect obtained by the applicator. This effect is particularly pronounced if the number of teeth and/or their dimensions in each comb are so great that said number or said dimensions could not be reproduced in the embodiment in the FIGS. 2 & 3, by giving the teeth a configuration that is helical locally. As can be seen in FIG. 20, in the present embodiment, the teeth in each row can be great in number and/or can have large dimensions because the zigzag or undulating disposition enables them to be positioned closer together. The embodiment in FIGS. 20 & 21 also provides a composition store effect at the teeth of each comb. In this embodiment, each helix extends over a 90° sector.

A sixth embodiment of the applicator 660 of the invention is shown in FIGS. 22 & 23. In these figures, the brush sectors and the teeth of the combs are omitted for clarity in the drawing. Only the bases 668 of the combs are conserved. Separators 680 that constitute the distinctive feature of this embodiment are also shown. In this embodiment, the separators are seven in number, but any number of separators could be provided, indeed even a single separator. Each separator has a plane shape. It is disposed perpendicularly to the axis 674 of the stem in such a manner as to extend over a limited angular sector around the stem, e.g. 120°, as shown in FIG. 23. In this embodiment, all of the separators 680 have the same shape, namely a disk-sector shape. They are each fastened to two bases 668 of the combs, forming a bridge going from one of the bases to the other.

The separators 680 are disposed as follows. Three of the separators 680 are disposed in coincidence when viewed from the end of the endpiece. The distance along the axis 674 between two consecutive separators of the three separators is the same as the distance between each end of the endpiece and the closest separator. The three separators are situated to the right in FIG. 22. Two other separators are provided in coincidence with each other, while nevertheless being angularly offset by 120° relative to the first three, and said two separators present a longitudinal offset relative to said first three. Finally, the last two separators situated to the right and to the rear in FIG. 22 are in coincidence with each other, but are angularly offset by 120° relative to the two previous groups. They also present a longitudinal offset relative to said two previous groups. The seven separators succeed one another in such a manner that one separator of each of the three groups is encountered in alternation. The seven separators are evenly spaced apart along the length of the endpiece.

The separators enable groups of eyelashes to be separated better from one another while using the applicator. In this embodiment, each separator is further provided with a cavity 681 forming a composition store. Although the separators are described as having the same shape and the same dimensions, the shape and/or the dimensions of the separators could vary one from another.

FIGS. 24 to 26 show hand movements for applying makeup that can be performed with an applicator of the invention, in particular any one of the applicators described above.

In FIG. 24, the endpiece (e.g. the endpiece 161 in FIG. 2) is oriented with its longitudinal axis 164 horizontal. The user performs a hand movement in translation towards the front, along a direction that is perpendicular to the axis. The direction is situated in the plane of the eyelashes, which is the plane in FIGS. 24 and 25 for the eyelashes visible in the figures. The direction is adjusted depending on whether makeup is being applied to the top or the bottom eyelashes of the eye, and from above or from below said eyelashes as shown in FIGS. 24 and 25.

In FIG. 25, the translation movement is combined with a turning movement about the axis 164, in a direction that increases friction between the applicator and the eyelashes.

In FIG. 26, the applicator is manipulated using the same movements, except that the axis 164 is inclined and the direction 190 is directed outwards and upwards, the applicator being moved along the eyelashes or the eyebrows in a direction going away from the nose 192 of the person being made up. The eyelashes are thus oriented outwards with a sidelong or doe-eyed effect.

Naturally, numerous modifications could be applied to the invention without going beyond the ambit thereof.

The number of combs on the applicator could be decreased to one or two, or, on the contrary, could be increased to four or more. The same applies for the number of brush sectors.

When the applicator includes at least two brush sectors, said sectors could have different dimensions or configurations. The same applies for the combs. In particular, the length of the fibers or of the teeth could vary from one brush sector to another or from one comb to another. The various combs could be made of different materials or could present colors that are different from one another. The same applies for the brush sectors. The applicator could include a complete bottle brush forming a single brush sector that is associated with at least one comb.

Within a single comb, the dimensions of the teeth and/or their arrangement could be different in different portions of the comb. It could also be envisaged that, at its ends, each comb presents portions in which the teeth are relatively short, while in the middle portion the teeth are long and more spaced apart than in the end portions. Short teeth make it possible to treat the small eyelashes at the corners of the eye, while long teeth make it possible to treat long eyelashes, so as to give them volume.

It is possible to envisage that the helixes forming the brush sectors do not have the same dimensional characteristics over the various brush sectors. The same also applies to the combs. The helixes of the various brush sectors could be oriented in different directions. The same applies for the helixes of the combs. In addition, the helix(es) of the brush sector(s) could turn in the opposite direction to the helix(es) of the comb(s). It is possible to envisage that the inclination of the helixes or of at least one of the helixes is not constant. It is thus possible to imagine that the inclination (measured relative to a plane perpendicular to the axis) increases towards the free end of the endpiece remote from the handle portion 12.

It is possible to envisage that the brush sector or each brush sector is a single part, e.g. being made by injection molding a synthetic material. In addition, if the brush sectors are at least two in number, e.g. three in number, they could form a single part only. The comb(s) could thus be fitted onto this part. Finally, the entire applicator (brush(es) and comb(s)) could be manufactured as a single injection-molded part. In this event, the fibers are distinguished from the teeth by their arrangement, their shape, and/or their dimensions. They could also be distinguished by the fact that the fibers are more flexible than the teeth, i.e. the teeth are more rigid than the fibers.

An applicator of the invention could be implemented, in which none of the rows is generally helical in shape, the applicator being, apart from this, in accordance with any one of the above-mentioned embodiments, for example. In the brush, the brush sector(s) and the comb(s) are rectilinear, for example. On this basis, it is possible, in particular, to envisage that the comb(s) extend beyond the brush(es) along the radial direction, as explained above. It is likewise possible to implement different colors.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. An applicator for applying a composition to the eyelashes and/or the eyebrows, the applicator comprising an endpiece comprising:

at least two brush sectors:

each comprising a row of fibers, and said at least two brush sectors being made of a bottle brush comprising a plurality of wires that trap fibers or bundles of fibers; and at least two combs, each of said at least two combs:

comprising a row of teeth, having a shape that is generally helical, and being situated adjacent at least one of said at least two brush sectors, said at least two combs:

being an integral, one-piece construction, being connected together at a longitudinal end of said at least two combs, and forming a cage for receiving said at least two brush sectors;

each of said at least two brush sectors having a generally helical shape outside the cage;

said at least two combs being spaced apart and alternating with said at least two brush sectors about an axis of the applicator, each one of the brush sectors and each one of the combs extending from approximately one longitudinal end of the endpiece to approximately another longitudinal end of the endpiece;

wherein said at least two brush sectors and said at least two combs spiral about said applicator axis.

2. An applicator according to claim 1, in which the helixes of the brush sectors and of the combs have the same axis.

3. An applicator according to claim 1, in which the helixes of the brush sectors and of the combs are oriented in the same direction.

4. An applicator according to claim 1, in which each row of teeth has a helical shape.

5. An applicator according to claim 3, in which said helixes, or at least one of said helixes, extends over an angular sector, about an axis of the applicator, that lies in the range 10° to 360°.

6. An applicator according to claim 1, in which each of said at least two brush sectors are evenly spaced apart about said axis of the applicator.

7. An applicator according to claim 1, in which each of said at least two combs are evenly spaced apart.

8. An applicator according to claim 1, in which a total number of said at least two brush sectors is equal to a total number of said at least two combs.

9. An applicator according to claim 1, in which said row of fibers and said row of teeth are uniformly distributed about said axis of the applicator.

10. An applicator according to claim 1, in which the teeth of said at least two combs are disposed locally one behind another in a zigzag configuration or in an undulating configuration.

11. An applicator according to claim 1, in which at least one of said at least two combs comprises at least two rows of teeth, the teeth of each row being aligned locally with one another, and being offset or inclined relative to the teeth of the other row or of one of the other rows.

12. An applicator according to claim 11, in which said teeth of one of said at least two rows of teeth diverge from their bases relative to the teeth of the other row or of one of the other rows.

13. An applicator according to claim 1, in which said row of teeth of one of said at least two combs extends radially, relative to an axis of the applicator, beyond a surface envelope defined by said at least one brush sector.

14. An applicator according to claim 1, in which said at least two brush sectors present a color that is different from a color of said at least two combs.

15. An applicator according to claim 1, in which the applicator includes at least one separator that extends in a plane that is perpendicular to a longitudinal axis of the applicator, being contiguous with at least one of said row of fibers or said row of teeth.

16. An applicator according to claim 15, in which a number of said at least one separator is greater than or equal to two, each of said at least one separator being offset from one another longitudinally along said longitudinal axis and/or angularly about said longitudinal axis.

17. An applicator according to claim 1, in which said at least one brush sector is a single part.

18. An applicator according to claim 17, in which said applicator comprises a plurality of brush sectors that form a single part.

19. An applicator according to claim 1, in which the applicator is a single part.

20. A kit for applying a composition to the eyelashes and/or the eyebrows, the kit comprising a reservoir of composition, and an applicator according to claim 1, the kit preferably further comprising a wiper.

21. A method of applying makeup to the eyelashes and/or the eyebrows, wherein a composition is applied to the eyelashes and/or the eyebrows by means of an applicator according to claim 1.

22. The method according to claim 21, in which the applicator is moved in translation along the eyelashes or the eyebrows along a direction that is parallel thereto.

23. The method according to claim 21, in which the applicator is moved along the eyelashes or the eyebrows with movement that comprises turning movement, the movement possibly further comprising movement in translation.

24. The method according to claim 23, in which the applicator is moved along the eyelashes or the eyebrows in a direction away from the nose of the person whose eyelashes or eyebrows are having makeup applied thereto.

25. A makeup effect, said makeup effect being obtained using an applicator according to claim 1.

26. A makeup effect, said makeup effect being obtained by means of the method according to claim 21.

27. An applicator according to claim 3, in which said helixes, or at least one of said helixes, extends over an angular sector, about an axis of the applicator, that lies in the range 20° to 130°.

28. An applicator according to claim 3, in which said helixes, or at least one of said helixes, extends over an angular sector, about an axis of the applicator, that lies in the range 50° to 100°.

29. An applicator according to claim 1, in which a number of said at least two brush sectors is greater than or equal to three.

30. An applicator according to claim 1, in which a number of said at least two brush sectors is equal to three.

31. An applicator according to claim 1, in which a number of said at least two combs is greater than or equal to three.

32. An applicator according to claim 1, in which a number of said at least two combs is equal to three.

33. An applicator according to claim 1, wherein said at least two combs are equally spaced apart about said axis of said applicator.

34. An applicator according to claim 1, wherein each one of said brush sectors and each one of said combs extend from said one longitudinal end to said another longitudinal end of said endpiece.

* * * * *